US010343013B2

(12) United States Patent
Xing

(10) Patent No.: US 10,343,013 B2
(45) Date of Patent: Jul. 9, 2019

(54) ELLIPTICAL TRAINER

(71) Applicant: OMA METAL INDUSTRIAL CO., LTD., Foshan (CN)

(72) Inventor: Kaibin Xing, Foshan (CN)

(73) Assignee: OMA METAL INDUSTRIAL CO., LTD., Foshan (CN)

( * ) Notice: Subject to any disclaimer, the term of this patent is extended or adjusted under 35 U.S.C. 154(b) by 0 days.

(21) Appl. No.: 15/611,215

(22) Filed: Jun. 1, 2017

(65) Prior Publication Data

US 2018/0290015 A1 Oct. 11, 2018

(51) Int. Cl.

| | |
|---|---|
| ***A63B 21/00*** | (2006.01) |
| ***A63B 22/06*** | (2006.01) |
| ***A63B 22/20*** | (2006.01) |
| ***A63B 22/00*** | (2006.01) |
| ***A63B 21/015*** | (2006.01) |
| ***A63B 21/22*** | (2006.01) |
| ***A63B 21/008*** | (2006.01) |

(52) U.S. Cl.

CPC .... *A63B 22/0664* (2013.01); *A63B 21/00069* (2013.01); *A63B 21/0088* (2013.01); *A63B 21/015* (2013.01); *A63B 21/225* (2013.01); *A63B 22/001* (2013.01); *A63B 22/0017* (2015.10); *A63B 22/201* (2013.01); *A63B 22/203* (2013.01); *A63B 2022/067* (2013.01); *A63B 2022/0676* (2013.01)

(58) Field of Classification Search

None

See application file for complete search history.

(56) References Cited

U.S. PATENT DOCUMENTS 4,537,396 A * 8/1985 Hooper ..... A63B 21/0088 482/56
4,589,656 A * 5/1986 Baldwin ..... A63B 22/0605 297/180.13
4,789,153 A * 12/1988 Brown ..... A63B 21/0088 482/111
4,981,294 A * 1/1991 Dalebout ..... A63B 22/001 482/59

(Continued)

*Primary Examiner* — Stephen R Crow

(74) *Attorney, Agent, or Firm* — Marshall A. Lerner; Marvin H. Kleinberg; Kleinberg & Lerner, LLP

(57) ABSTRACT

The invention relates to an elliptical trainer including: a frame having a first end and a second end; a rocker-rod mechanism hingedly connected to the first end of the frame; a pedal mechanism connected to the frame and the rocker-rod mechanism, the pedal mechanism being linked with the rocker-rod mechanism on the frame; a resistance adjustment mechanism provided at the first end of the frame, the resistance adjustment mechanism being connected to the pedal mechanism through a transmission mechanism for adjusting the movement resistance of the pedal mechanism. In the apparatus of the invention, there are two resistance adjustment ways i.e. manual resistance adjustment and electronic-controlled resistance adjustment, the user can select any one or both according to requirements. By combining the manual adjustment and the electronic controlled adjustment, the adjustable range of movement resistance is increased, and not only a wide range resistance control is achieved, but also fine-tuning of the movement resistance can be achieved manually.

8 Claims, 4 Drawing Sheets

(56) References Cited

U.S. PATENT DOCUMENTS

| | | | | | |
|---|---|---|---|---|---|
| 5,083,772 | A * | 1/1992 | Brown | A63B 24/00 482/59 |
| RE34,478 | E * | 12/1993 | Dalebout | A63B 21/015 482/59 |
| 5,743,834 | A * | 4/1998 | Rodgers, Jr. | A63B 22/001 482/51 |
| 5,916,064 | A * | 6/1999 | Eschenbach | A63B 22/001 482/51 |
| 9,643,044 | B1 * | 5/2017 | Hsu | A63B 22/0076 |
| 9,919,184 | B2 * | 3/2018 | Lin | A63B 22/0605 |
| 2002/0137601 | A1 | 9/2002 | Tobias et al. | |
| 2014/0194253 | A1 | 7/2014 | Huang et al. | |
| 2014/0274575 | A1 | 9/2014 | Yim et al. | |
| 2017/0056709 | A1 | 3/2017 | Ercanbrack et al. | |
| 2017/0274238 | A1 * | 9/2017 | Chou | A63B 21/0088 |
| 2017/0326410 | A1 * | 11/2017 | Lin | A63B 22/0605 |

* cited by examiner

ELLIPTICAL TRAINER

FIELD

The application relates to the technical field of exercise equipment, and more particularly to an elliptical trainer.

BACKGROUND

Elliptical trainer is a recently emerging exercise fitness equipment, and generally refers to a variety of devices which can guide the left and right pedals to move along an elliptical trajectory or a trajectory in similar shape for the user to simulate leg movements such as walking, running, and stair climbing.

Although the existing front-type elliptical trainer has a certain resistance adjustment function, the adjustment form is single, and the adjustable range is small, therefore it can not achieve a well user experience, which not only makes it impossible to choose the movement form according to the personal preference and choose the muscle parts that the user wants to exercise, but also makes the movement lack changes and be monotonous. Moreover, the existing resistance adjustment mechanism performs resistance adjustment by the operation on the control panel, and the transmission mechanism is complex, so the cost is high, and it is unable to meet the needs of different consumers.

The above-mentioned information disclosed in the background is only intended to enhance the understanding of the background of the invention and therefore may contain information that is not the prior art known to those skilled in the art.

SUMMARY

In view of this, the embodiments of the present application provide an elliptical trainer to solve at least the problems existing in the prior art.

The technical solutions of the embodiments of the present application are implemented as following. According to an embodiment, it is provided an elliptical trainer including: a frame having a first end and a second end; a rocker-rod mechanism hingedly connected to the first end of the frame; a pedal mechanism connected to the frame and the rocker-rod mechanism, the pedal mechanism being linked with the rocker-rod mechanism on the frame; and a resistance adjustment mechanism provided at the first end of the frame, the resistance adjustment mechanism being connected to the pedal mechanism through a transmission mechanism for adjusting a movement resistance of the pedal mechanism.

In some embodiments, the resistance adjustment mechanism includes a flywheel rotatably connected to the first end of the frame, a hood is sleeved outside the flywheel, and an air outlet and an air inlet are arranged on the hood.

In some embodiments, a plurality of blades for guiding air are provided on the flywheel in the circumferential direction.

In some embodiments, an outlet air adjustment mechanism which can be opened and closed is provided at the air outlet for adjusting the air volume of the air outlet or closing the air outlet.

In some embodiments, the air outlet is arranged on the hood above the flywheel, and the air inlet is arranged on the hood at both sides of the flywheel.

In some embodiments, the transmission mechanism includes a turntable rotatably connected to the first end of the frame, and the turntable is connected to a rotation shaft of the flywheel through a belt.

In some embodiments, a clip board is rotatably provided on the rotation shaft, and a tension pulley fitting with the belt is provided on the clip board.

In some embodiments, the pedal mechanism includes a support rod and a pedal provided on the support rod, one end of the support rod is slidablely connected to the second end of the frame, and the other end of the support rod is hingedly connected to the transmission mechanism.

In some embodiments, the rocker-rod mechanism includes two rocker rods arranged symmetrically on the frame, one end of the rocker rod is hingedly connected to the frame, and the other end of the rocker rod is connected to the support rod through a link.

In some embodiments, one end of the link is hingedly connected to the other end of the rocker rod, and the other end of the link is hingedly connected to the support rod.

In some embodiments, the clip board is connected to a drive device for driving the clip board to rotate, and a control device is provided at the first end of the frame, and the control device is electrically connected to the drive device.

The invention has the following advantages by adopting the above technical solutions: 1. in the apparatus of the invention, since a plurality of blades are provided on the periphery of the flywheel, the capability of the freewheel for guiding air is enhanced, which enables low pressure to be formed in the hood, thereby increasing the rotation resistance of the flywheel. 2. in the apparatus of the invention, since an air inlet and an air outlet are arranged in the hood, an outlet air adjustment mechanism is provided at the air outlet, and the swing leaf of the outlet air adjustment mechanism can be adjusted by a knob, the user can manually adjust the air volume during movement to change the movement resistance as needed, without the need of adjustment from an external control system. 3. in the apparatus of the invention, since a tension pulley for tensioning a belt is provided, the tension pulley is connected to a drive device through the clip board, and the drive device is electrically connected to a control device, the user can perform control and adjustment according to the movement demand. 4. in the apparatus of the invention, since there are two resistance adjustment ways i.e. manual resistance adjustment and electronic-controlled resistance adjustment, the user can select any one or both according to requirements to perform adjustment, and by combining the manual adjustment and the electronic controlled adjustment, the adjustable range of movement resistance is increased, and not only a wide range resistance control is achieved, but also fine-tuning of the movement resistance can be achieved manually.

The above summary is merely for the purpose of illustration and is not intended to be limited in any way. In addition to the aspects, embodiments and features described above, further aspects, embodiments, and features of the invention will be readily apparent from the following detailed description with reference to the accompanying drawings.

BRIEF DESCRIPTION OF THE DRAWINGS

In the drawings, the same reference numerals refer to like or similar parts or elements throughout several drawings, unless otherwise specified. These drawings are not necessarily drawn to scale. It is to be understood that these drawings only depict some embodiments according to the present disclosure and should not be construed as limiting the scope of the invention.

DETAILED DESCRIPTION

In the following, only certain exemplary embodiments are briefly described. As will be appreciated by those skilled in the art, the described embodiments may be modified in various different ways without departing from the spirit or scope of the invention. Accordingly, the drawings and description are to be regarded as being illustrative in nature and not restrictive.

In the description of the invention, it is to be understood that the orientation or positional relationship indicated by the terms "center", "longitude", "transverse", "length", "width", "thickness", "upper", "lower", "front", "behind", "left", "right", "vertical", "horizontal", "top", "bottom", "internal", "external", "clockwise", "counterclockwise" is based on the orientation or positional relationship indicated in the figures, and is merely intended to facilitate illustration of the invention and simplify the description and is not intended or implied that the devices or elements indicated must have a specific orientation and be constructed and operated in a particular orientation and therefore can not be understood as limitations to the invention. In addition, the terms "first" and "second" are merely for illustrative purposes and are not to be construed as indicating or imposing a relative importance or implicitly indicating the number of technical features indicated. Thus, a feature that is defined using "first" or "second" may expressly or implicitly include one or more the features. In the description of the invention, the meaning of "a plurality of" refers to two or more, unless otherwise specifically defined.

In the description of the invention, it is to be noted that, unless otherwise expressly specified or limited, the terms "mount," "connect", "couple" are to be broadly understood, for example, it may be fixed connection, detachable connection, or integral connection; it may be mechanical connection or electrical connection or communication with each other; it may be direct connection or indirect connection by an intermediate medium; it may be interconnection of two elements or an interaction relationship of two elements. The specific meanings of the above terms in the invention may be understood by those skilled in the art in light of the circumstances.

Figure 1:
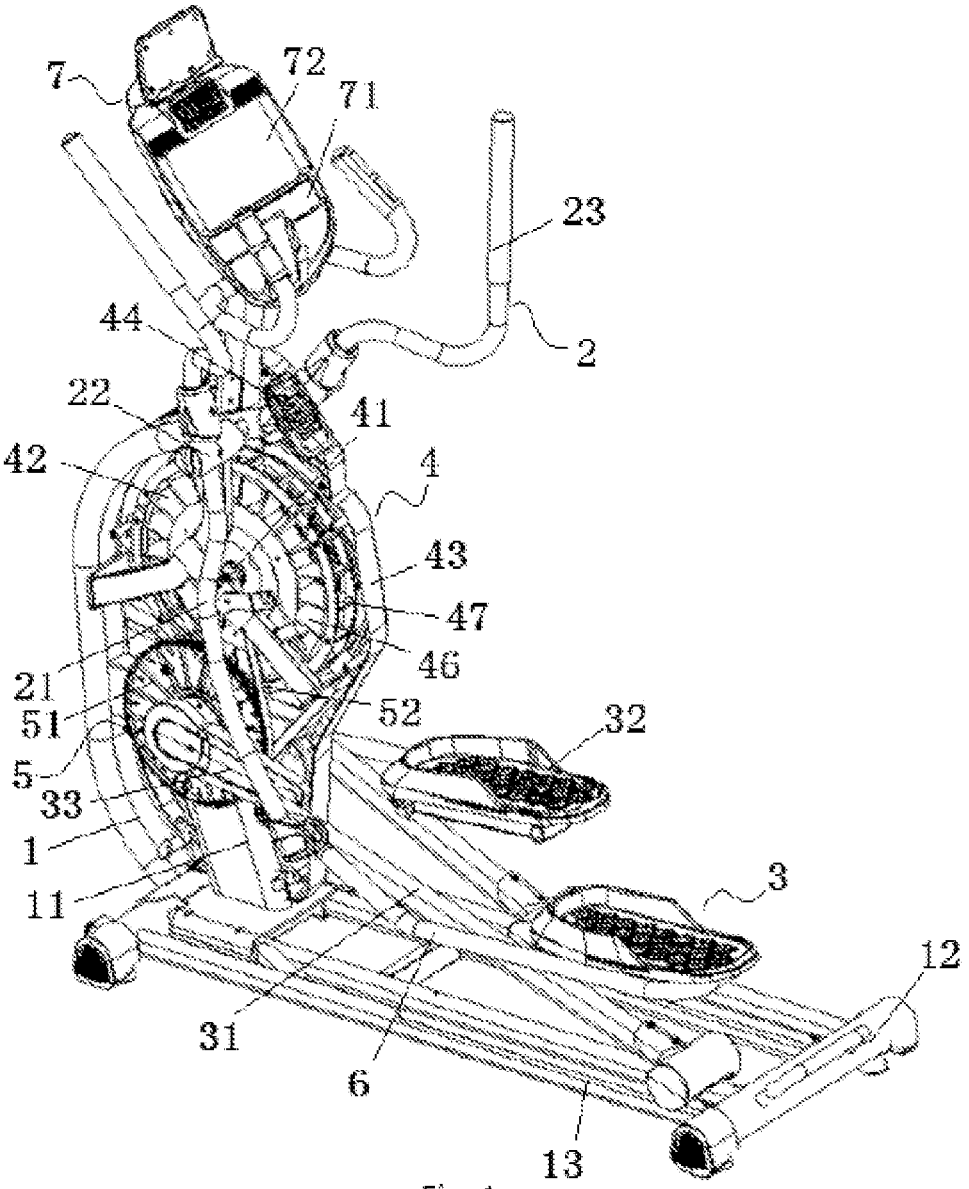
FIG. 1 is a schematic view of the overall structure of the present invention.

Specifically, as shown in FIG. 1, the apparatus of the invention includes a frame 1 fixed to the ground, and the frame 1 has a first end 11 and a second end 12. A rocker-rod mechanism 2 is provided on the frame 1, and the rocker-rod mechanism is hingedly connected to the first end 11 of the frame 1 for manipulation by the user's hand. A pedal mechanism 3 is also provided on the frame 1, and the pedal mechanism 3 is connected to the frame 1 and the rocker-rod mechanism 2. By manipulating the pedal mechanism 3 with the user's leg and foot, the linkage between the pedal mechanism 3 and the rocker-rod mechanism 2 on the frame is realized, so that the pedal mechanism 3 can move along a substantial elliptical trajectory relative to the frame 1. The apparatus further includes a resistance adjustment mechanism 4 arranged at the first end 11 of the frame 1, the resistance adjustment mechanism 4 is connected to the pedal mechanism 3 through a transmission mechanism 5 for adjusting the movement resistance of the pedal mechanism 3 to provide different exercise demands for the user.

Figure 2:
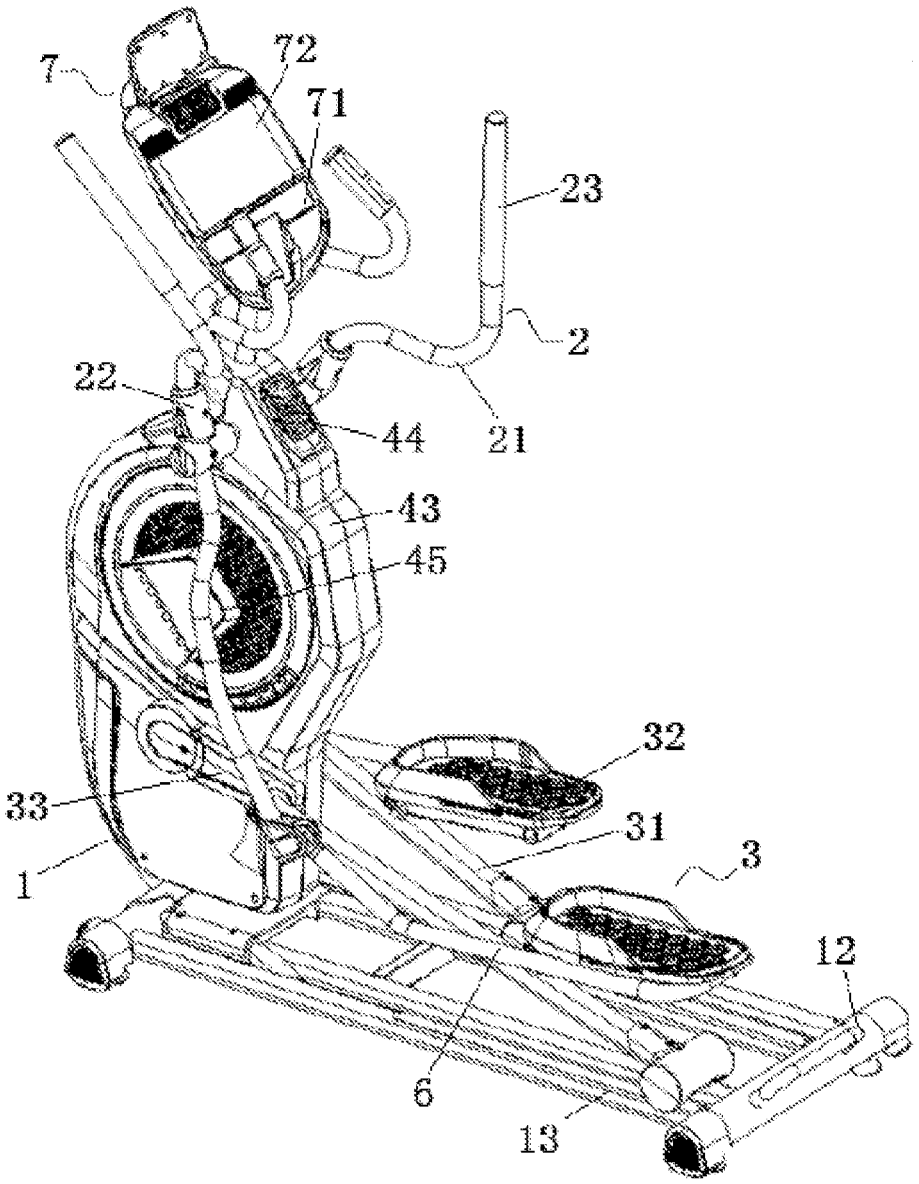
FIG. 2 is a view showing the structure of a hood of the present invention.
Figure 3:
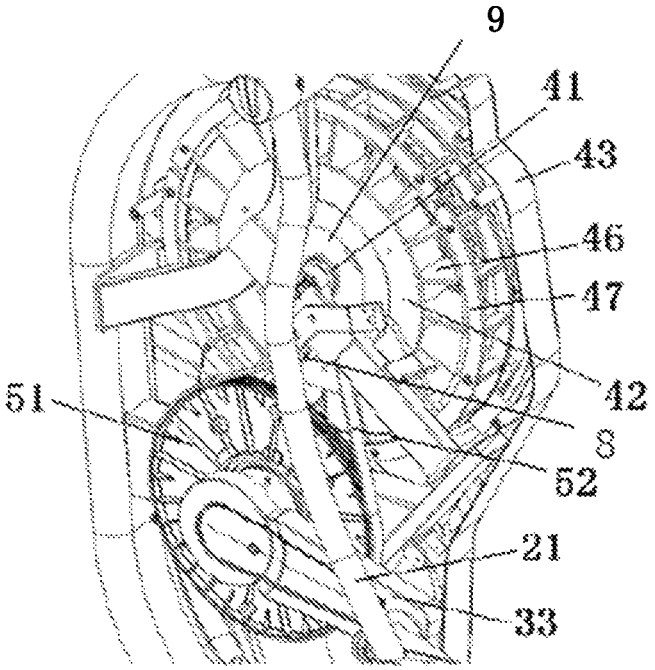
FIG. 3 is a partial enlarged view of a resistance adjustment mechanism and a transmission mechanism of the present invention.

As shown in FIGS. 1 to 3, the resistance adjustment mechanism 4 includes a flywheel 42 rotatably connected to the upper portion of the first end 11 of the frame 1 by means of a rotation shaft 41, and a hood 43 which is detachably connected to the frame 1 is sleeved outside of the flywheel 42. A relatively enclosed space is formed inside the hood 43 so that a certain pressure can be formed in the hood 43 during the operation of the flywheel 42 in the hood 43. In order to facilitate the flow of air in the hood 43, an air outlet 44 and an air inlet 45 can be arranged on the hood 43.

In a preferred embodiment, in order to make air flow fluidly and improve the working efficiency of the flywheel 42, the air outlet 44 can be arranged on the hood 43 above the flywheel 42, and two air inlets 45 can be arranged on the hood 43 at both sides of the flywheel 42, and the two air inlets 45 are arranged symmetrically.

It is to be noted that the number and the arrangement positions of the air inlets 45 and the air outlets 44 can be set as required. For example, an air outlet 44 is provided on the upper portion of the hood 43 at the side near the pedal mechanism 3, and another air outlet 44 is provided on the upper portion of the hood 43 at the side remote from the pedal mechanism 3, and one or more air inlets 45 can be provided on the hood 43 at both sides of the fly wheel 42.

As shown in FIGS. 1 and 3, the transmission mechanism 5 includes a turntable 51 rotatably connected to the first end 11 of the frame 1 below the flywheel 42, and the turntable 51 is connected to the rotation shaft 41 through a belt 52 so as to together constitute a belt drive mechanism.

As shown in FIGS. 1 to 3, the pedal mechanism 3 includes a support rod 31 and a pedal 32 provided on the support rod 31. One end of the support rod 31 is slidably connected to the second end 12 of the frame 1, and the other end of the support rod 31 is hingedly connected to the turntable 51. When one end of the support rod 31 is rotated with the turntable 51, the other end of the support rod 31 performs reciprocating movement between the second end 12 and the first end 11 of the frame 1 so that the pedal 32 moves along a substantially elliptical trajectory.

It is to be noted that a sliding slot 13 is provided on both sides of the bottom of the frame 1, and one end of the support rod 31 slides in the sliding slot 13, wherein the one end of the support rod 31 can slide in the sliding slot 13 by means of a roller or directly slide in the sliding slot 13.

It is to be noted that the other end of the support rod 31 can be directly hingedly connected to the turntable 51 or the other end of the support rod 31 is hingedly connected to one end of an auxiliary link 33, and the other end of the auxiliary link 33 is connected to the center of the turntable 51, thereby increasing the flexibility of the movement formation and the pedal mechanism 3.

As shown in FIGS. 1 and 2, the rocker-rod mechanism 2 includes two rocker rods 21 which are symmetrically arranged on the first end 11 of the frame 1. The upper end of the rocker rod 21 is hingedly connected to the first end of the frame 1 by means of a connecting member 22 and the other end of the rocker rod 21 is hingedly connected to the support rod 31, thereby realizing the linkage between the rocker rod 21, the support rod 31 and the pedal 32.

In a preferred embodiment, in order to improve the movement flexibility, a link 6 may be provided between the rocker rod 21 and the support rod 31, one end of the link 6 is hingedly connected to the other end of the rocker rod 21, and the other end of the link 6 is hingedly connected to the support rod 31.

In order to meet the needs of different users, a handle 23 can be detachably arranged at the upper end of the rocker rod 21, the handle 23 is in a bent shape and rotatable relative to the rocker rod 21, and can be adjusted as necessary.

As shown in FIGS. 1 and 3, a plurality of blades 46 for guiding air are provided on the periphery of the flywheel 42 in the circumferential direction. When the flywheel 42 is rotated, the outside air enters the inside of the hood 43 through the air inlet 45, the air continuously enters the inside of the hood 43 under the rotation movement of the blades 46 and is discharged from the air outlet 44 to form a circulating air flow. During this process, a local low pressure environment is formed in the hood 43, resulting in a certain movement resistance. When the movement speed of the control pedal mechanism 3 manipulated by the user is faster, the air resistance generated by the flywheel 42 is greater, thereby increasing the exercise intensity of the user.

It is to be noted that the flywheel 42 may employ any mechanism in the existing devices that can guide air.

In a preferred embodiment, the flywheel 42 may employ for example a fan structure or a windmill structure, and in order to increase the working strength of the blades 46, a reinforcing ring 47 may be provided on the periphery of the flywheel 42. By the reinforcing ring 47, the blades 46 are connected into a unitary structure, thereby increasing the strength of the blades 46.

In order to meet the different needs of the user for the movement resistance, an outlet air adjustment mechanism 47 may be provided at the air outlet 44 for adjusting the air volume of the air outlet 44, and the user may adjust the outlet air adjustment mechanism 47 as needed. When the outlet air adjustment mechanism 47 is fully opened, the air volume of the air outlet 44 is maximum, and the movement resistance generated at this time is maximum and the movement intensity of the user is maximum. When the outlet air adjustment mechanism 47 reduces the air volume of the air outlet 44 or completely closes the air outlet 44, the resulting movement resistance is gradually reduced and the movement intensity of the user is gradually reduced.

Figure 4:
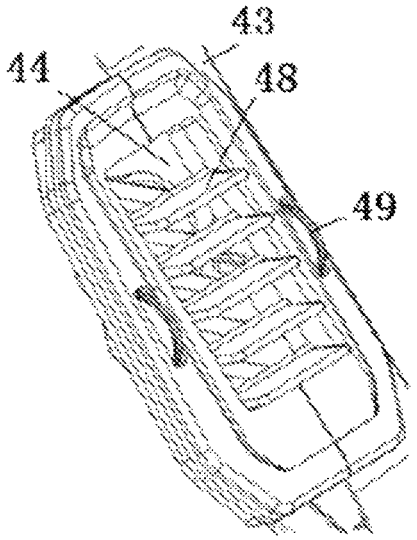
FIG. 4 is a partial enlarged view of an outlet air adjustment mechanism of the present invention.
Figure 5:
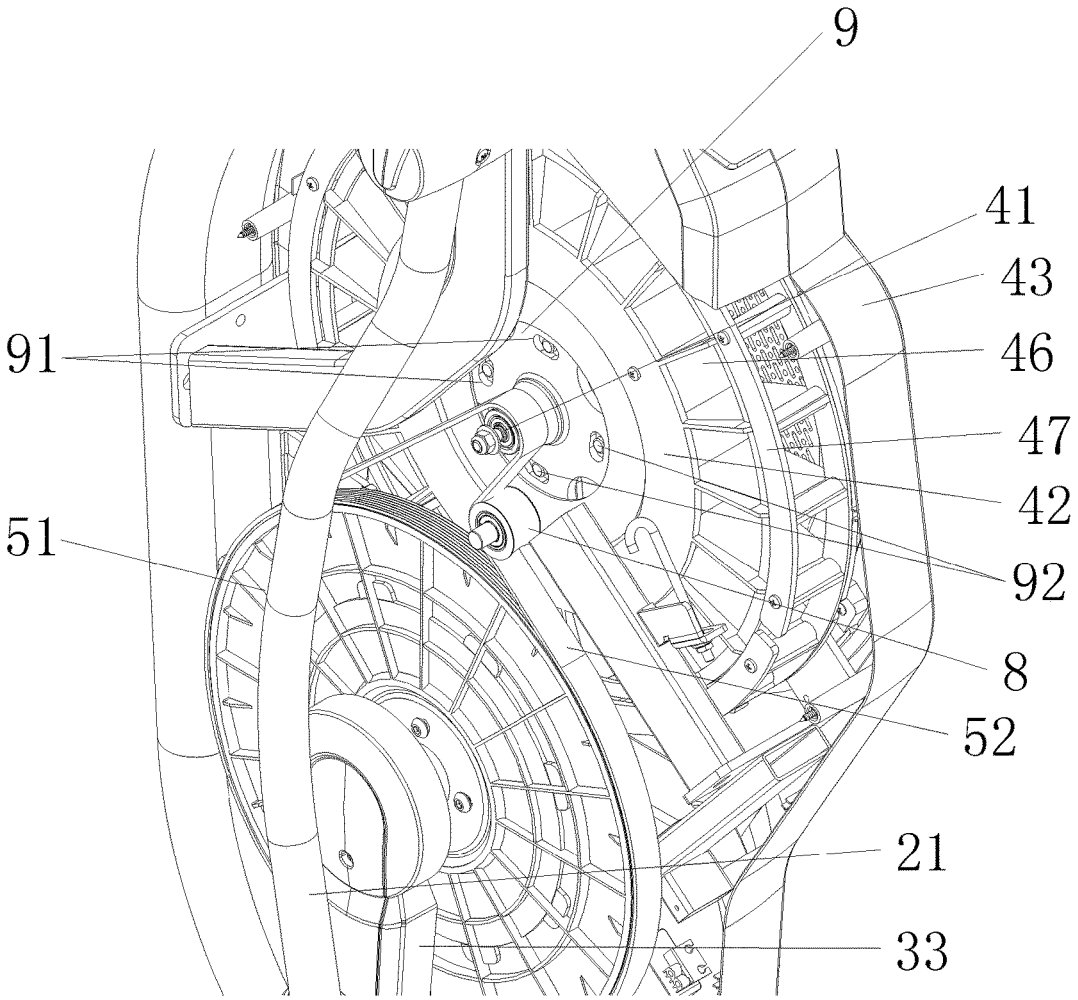
FIG. 5 is a partial enlarged view of a clip board according to an embodiment of the present invention.

As shown in FIG. 4, the outlet air adjustment mechanism 47 includes a plurality of swing blades 48 rotatably connected to the air outlet 44 and a knob 49 for controlling the swing blades 48 to rotate together, and when the user turns the knob 49, the swing blades 48 simultaneously swings in one direction to realize the opening and closing of the air outlet 44, thereby realizing the adjustment of the air volume.

In a preferred embodiment, in order to increase the resistance control way and the adjustable range, a clip board 9 is rotatably provided on the rotation shaft 41 of the flywheel 42, and a tension pulley 8 fitting with a belt 52 is provided on the belt 52, for adjusting the tension of the belt 52, thereby changing the rotation resistance of the flywheel 42 driven by the rotation shaft 41. The clip board 9 is connected to a drive device for controlling the rotation of the clip board 9 relative to the rotation shaft 41.

It is to be noted that, in order to control the rotation angle of the clip board 9, a plurality of limit slots 91 may be provided on the clip board 9 in the circumferential direction, and a plurality of limit protrusions 92 fitting with the plurality of limit slots may be provided on the first end 11 of the frame 1. The limit protrusion 92 is in the limit slot 91, and when the clip board 9 is rotated, the limit slot 91 is rotated, and when the limit slot 91 is in contact with the limit protrusion 92, the clip board 9 stops rotating, thereby achieving a limit to the clip board 9. When the clip board 9 is rotated counterclockwise, the tension pulley 8 moves with the clip board 9 and tensions the belt 52 to increase the rotation resistance of the turntable 51 and the flywheel 42. When the clip board 9 is rotated clockwise, the tension pulley 8 moves with the clip board 9 and loosens the belt 52 to reduce the rotation resistance of the turntable 51 and the flywheel 42. On the contrary, depending on the position of the tension pulley 8, the tension pulley 8 can loosen the belt 52 when the clip board 9 is rotated counterclockwise, and the tension pulley 8 tensions the belt 52 when the clip board 9 is rotated clockwise. By tensioning or loosening the belt 52, the rotation resistance of the turntable 51 and the flywheel 42 is controlled so that the user's legs and feet are subjected to a different degree of difficulty of movement.

In another preferred embodiment, a magnetic-controlled device (not shown) may be provided on the rotation shaft 41, the magnetic-controlled device is connected to a drive device, the rotation resistance of the rotation shaft 41 is adjusted by the magnetic force supplied to the magnetic-controlled device by the drive device so that the user's leg and foot are subjected to a different degree of difficulty of exercise experience.

As shown in FIGS. 1 and 2, the apparatus of the invention further comprises a control device 7 provided at the upper end of the first end 11 of the frame 1, the control device 7 includes a control panel 71 and a display screen 72, and is electrically connected to the drive devices for controlling the clip board and the magnetic-controlled device. The user controls and adjusts the power provided by each drive device through the control panel 71, thereby adjusting different movement resistance, and the user can individually adjust according to the real-time data displayed on the display screen 72

In the above embodiment, the hood 43 can cover inside the flywheel 42 and the turntable 51 on the first end 11 of the frame 1 so as to form a housing to prevent the resistance adjustment mechanism and the transmission mechanism from being damaged.

When the apparatus of the invention is in operation, the user steps on the pedal 32 with two feet and holds the rocker rod 21 with two hands, and by the forces provided by the legs and feet, the front end of the support rod 31 at the bottom of the pedal 32 rotates with the turntable 51, thus driving the flywheel 42 to rotate. When the flywheel 42 is rotated, the outside air is sucked into the hood 43 through the air inlet 45 and discharged from the air outlet 44. At the same time, when the front end of the support rod 31 is rotated in the circumferential direction, the rear end of the support rod 31 reciprocates between the second end 12 and the first end 11 of the frame 1, and the hand controlled rocker rod 21 performs the front and rear movement with the movement of the pedal 32, the rocker rod 21, the support rod 31 and the pedal 32 are linked with each other. When the user needs to adjust the resistance, the movement resistance can be changed as follows: 1. The moving speed of the user's hand and the foot is accelerated, thereby the rotational speed of the flywheel 42 is increased, and the rotation resistance of the flywheel 42 is increased under the air guiding action of the blades 46 of the flywheel 42, thus the movement resistance of the pedal mechanism 3 and the rocker-rod mechanism 2 is increased, thereby increasing the exercise intensity of the user. 2. The user turns the knob 49 at the air outlet 44 to change the rotation angle of the swing leaf 48 of the outlet air adjustment mechanism 47 and adjust the air volume of the air outlet 44. When the air volume of the air outlet 44 is increased, the rotation resistance of the flywheel

42 is increased, and the movement resistance of the user is reduced. 3. The user adjusts the tension of the tension pulley to the belt 52 by the control device 7, thereby changing the rotation resistance of the turntable 51 and the flywheel 42, and adjusting the exercise intensity of the user. 4. The user first changes the tension of the belt 52 by the control device 7, and thus adjusts the rotation resistance of the turntable 51 and the flywheel 42 to change the movement resistance, and at the same time, the user can manually adjust the air volume of the air outlet 44 by the knob 49, thus further fine-adjusting the rotation resistance of the turntable 51 and the flywheel 42 so as to appropriately change the movement resistance.

The foregoing are merely specific embodiments of the invention, but the scope of the invention is not to be limited thereto. The person skilled in the art can easily conceive various changes or replacements within the scope of the invention as disclosed, and these change or replacements are to be contained within the scope of the invention. Accordingly, the scope of protection of the invention should be based on the scope of protection of the claims.

What is claimed is:

1. An elliptical trainer, comprising:

a frame having a first end and a second end;

a rocker-rod mechanism hingedly connected to the first end of the frame;

a pedal mechanism connected to the frame and the rocker-rod mechanism, the pedal mechanism being linked with the rocker-rod mechanism on the frame; and a resistance adjustment mechanism provided at the first end of the frame, the resistance adjustment mechanism being connected to the pedal mechanism through a transmission mechanism for adjusting a movement resistance of the pedal mechanism;

wherein the resistance adjustment mechanism comprises a flywheel rotatably connected to the first end of the frame, a hood sleeved outside the flywheel, and an air outlet and an air inlet are arranged on the hood; and an outlet air adjustment mechanism with a plurality of swing blades is provided at the air outlet, and the outlet air adjustment mechanism further comprises a knob provided at the hood and configured to control the plurality of swing blades, the air volume passing through the outlet air adjustment mechanism is adjusted by rotating the plurality of swing blades of the outlet air adjustment mechanism simultaneously in one direction.

2. The elliptical trainer according to claim 1, wherein a plurality of blades for guiding air are provided on a periphery of the flywheel.

3. The elliptical trainer according to claim 1, wherein the air outlet is arranged on the hood above the flywheel, and the air inlet is arranged on the hood at both sides of the flywheel.

4. The elliptical trainer according to claim 1, wherein the transmission mechanism comprises a turntable rotatably connected to the first end of the frame, and the turntable is connected to a rotation shaft of the flywheel through a belt.

5. The elliptical trainer according to claim 4, wherein a clip board is rotatably provided on the rotation shaft, and a tension pulley fitting with the belt is provided on the clip board.

6. The elliptical trainer according to claim 1, wherein the pedal mechanism comprises a support rod and a pedal provided on the support rod, one end of the support rod is slidablely connected to the second end of the frame, and another end of the support rod is hingedly connected to the transmission mechanism.

7. The elliptical trainer according to claim 6, wherein the rocker-rod mechanism comprises two rocker rods arranged symmetrically on the frame, one end of the rocker rod is hingedly connected to the frame, and another end of the rocker rod is connected to the support rod through a link.

8. The elliptical trainer according to claim 7, wherein one end of the link is hingedly connected to the other end of the rocker rod, and another end of the link is hingedly connected to the support rod.

* * * * *